United States Patent [19]

Duffner

[11] 4,432,283

[45] Feb. 21, 1984

[54] PROJECTILE FUSE RESPONSIVE TO THE SPINNING MOTION OF A PROJECTILE

[75] Inventor: Erich Duffner, Schramberg, Fed. Rep. of Germany

[73] Assignee: Gebruder Junghans GmbH, Schramberg, Fed. Rep. of Germany

[21] Appl. No.: 325,862

[22] Filed: Nov. 30, 1981

[30] Foreign Application Priority Data

Dec. 11, 1980 [DE] Fed. Rep. of Germany ..... 3046620

[51] Int. Cl.[3] ..... F42C 15/34

[52] U.S. Cl. ..... 102/244; 102/240

[58] Field of Search ..... 102/237, 238, 240, 243, 102/244, 231

[56] References Cited

U.S. PATENT DOCUMENTS

| | | | |
|---|---|---|---|
| 1,569,248 | 1/1926 | Adelman | 102/243 X |
| 1,956,222 | 4/1934 | Methlin | 102/243 |
| 2,164,797 | 7/1939 | Birkigt | 102/237 X |
| 3,585,935 | 6/1971 | Birkigt | 102/240 |
| 4,223,608 | 9/1980 | Backstein et al. | 102/244 |

FOREIGN PATENT DOCUMENTS

| | | | |
|---|---|---|---|
| 77566 | 1/1916 | Austria | 102/240 |
| 2431113 | 7/1978 | France | 102/237 |

*Primary Examiner*—David H. Brown

*Attorney, Agent, or Firm*—Burns, Doane, Swecker & Mathis

[57] ABSTRACT

A projectile fuse has two activating devices acting independent of each other. One of the devices includes a plurality of wafer-like sectors which are retained together as a unitary disk by means of a coil spring having 1.5 to 2 convolutions. The disk is arranged in a bore of the fuse housing and normally covers a vent which is concentrically positioned in the bore. Under the effect of rotationally generated centrifugal forces occurring upon firing, the sectors force open the spring and thereby expose the vent for passage of an ignition flash.

4 Claims, 1 Drawing Figure

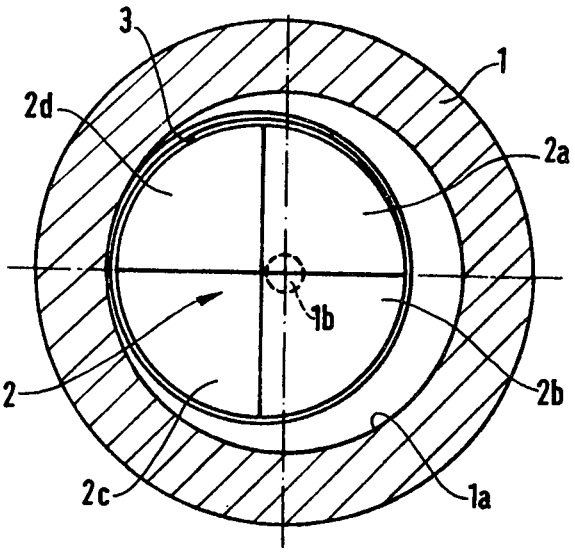
3
1
2d
2a
1b
2
2b
2c
1a

PROJECTILE FUSE RESPONSIVE TO THE SPINNING MOTION OF A PROJECTILE

BACKGROUND AND OBJECTS OF THE INVENTION

The invention concerns the automatic activation of a fuse or ignition system serving to ignite fired projectiles, in particular spinning projectiles. The fuse includes at least two independent systems, one of which acts automatically when a predetermined number of revolutions is attained by the fired projectile.

The fuses of projectiles and their safety and activation systems usually must satisfy high requirements, in order to comply with the safety needs of the users. They must, above all, exhibit high mechanical strength to insure safety under all conceivable environmental conditions. This requires, among other requirements, that with regard to their structural layout, any defective assembly of the structural parts which would endanger safety, must be excluded. It further requires the faultless functioning of the activation systems during the assembly and the subsequent functional testing. Even though the above-mentioned absolute requirements demonstrate by themselves the care an ignition system requires, they are not satisfied by the structural design measures alone. Ignition systems must remain secured for a predetermined distance or during a predetermined time following the firing. During this period of time, the ignition system must not respond, for example, upon its impact against an obstacle or the receipt of an ignition signal.

Furthermore, the ignition system must not assume its activated state prior to attaining its activation time, upon the failure or loss of a structural part (group). To insure this, the system must contain two activating devices that are independent of each other and which require for their actuation environmental forces acting independently of each other. Complete activation therefore must be possible only as the result of firing (or its simulation).

The fact that relatively few of the known projectile fuse activation systems are satisfying these requirements is the result, among others, of the condition that it is difficult to install two systems acting independently of each other, in a relatively small structural space in the nose of the projectile. If, for example, electric or electronic systems are used, the size of the structural space available is of least importance, but in the case of such a system, the problem of the power supply must receive special attention. Even though entirely usable miniature batteries, button cells, etc., are available for this purpose, they have limited shelf life and applicability, not the least of which being the voltage drop taking place at low environmental temperatures. In view of this fact, attempting to maintain the power supply permanently in the ready condition in a peacetime, average-size stock of projectiles, would pose practically insoluble problems for ammunition depots and the like.

It is conventional to provide a vent in the fuse housing, which vent when exposed is operable to pass an ignition flash. Due to the drawbacks of electrical ignition systems, it is known to use a mechanical lever covering the vent and thus securing it, which lever exposing the vent under certain conditions.

Aside from the fact that the geometric and spatial conditions in the fuse of a projectile permit only a scant covering of the vent by the closing lever, the latter also has the disadvantage that it operates in a position-dependent manner. This means that it may expose the vent under certain conditions when not desired, for example when dropped, impacted or the like.

In view of this, it is the object of the invention to provide a structurally simple activation device, responsive to the rotational forces occurring upon the firing of the projectile, and only after a minimum rpm of the projectile has been attained. It should be understood that this device represents only one of the activating devices required in the fuse of the projectile.

SUMMARY OF THE INVENTION

This object is attained according to the invention by the second activating device which comprises a plurality of leaf-like sectors, defining together a rotation-symmetrical disk held together by a coil spring or the like. The diameter of the disk is smaller than that of a bore also of a rotation-symmetrical configuration arranged in the fuse housing and serving to guide and support the disk. A vent is located centrally of the bore and is normally covered by the disk. Regardless of the behavior of the sectoral disk under the effect of an impact, the sectors are urged outwardly toward the fuse housing by rotational forces against the spring bias, thereby exposing the vent so as to pass the conventional ignition flash.

Preferably, the coil spring is formed of a flat steel strip and has approximately 1.5–2 convolutions.

According to a further characteristic of the invention, the bore of the fuse housing is such that the sectoral disk performs a wobbling motion therein under the effect of an impact.

The device is exceedingly simple and inexpensive in its structural layout, the more so since only a few individual parts are required. The disk, preferably dividable into four sectors, may be designed without difficulty as a stamped part, while the flat coil spring is available commercially with the proper dimensions. Aside from the rotation-symmetrical bore in the fuse housing, no special drilling or milling operations are necessary.

The simple design layout of the invention is accompanied by a high degree of operating and functional safety, demonstrated among others by a desirable large overlap of the vent, which is provided by the known cover lever conditionally only or not at all.

THE DRAWING

The invention is represented in the drawing by a preferred embodiment. The single FIGURE shows a horizontal cross-section through the fuse housing as viewed in the direction of the vent covered by the sectoral leaves of the disk.

DETAILED DESCRIPTION OF A PREFERRED EMBODIMENT OF THE INVENTION

A fuse housing 1 has a concentric bore 1*a*. A thin, wafer-like disk 2 is inserted loosely in the bore 1*a*. The disk 2 is divided into a plurality (e.g., four) of independent sectors 2*a*, 2*b*, 2*c*, 2*d*. The sectors of the disk are encompassed peripherally by a coil spring 3 made of a flat steel strip or the like and having from 1.5 to 2 convolutions. By means of this arrangement, the four-part disk constitutes a single unit. Underneath the disk 2, in the center of the fuse housing 1, a vent 1*b* is located. This vent 1*b* is conventional in projection fuses and is arranged to admit a standard ignition flash. In the absence of rotational forces, i.e., for example prior to the firing of the projectile (not shown) equipped with the fuse, the vent 1*b* is always covered securely by the disk 2, since the disk sectors are held closed by the spring 3. In the case of the fuse being impacted, the disk will merely wobble around in the bore without exposing the vent.

If, however, as in the case of firing from a barrel of a weapon, the projectile is given a rotating motion, the spring 3 is subjected to centrifugal force and opens after a predetermined rpm has been attained. The sectors 2*a*, 2*b*, 2*c*, 2*d*, also exposed to rotating acceleration, press the few convolutions of the spring 3 apart, under the action of the centrifugal forces generated by the rotating motion. The sectors 2*a*, 2*b*, 2*c*, 2*d*, freed of the constraint of the spring 3, are now urged peripherally toward arbitrary locations of the bore 1*a* and simultaneously expose the vent 1*b*, thus opening it to the passage of the igniting flash.

It should be understood that the above-described activating device is operating independent of at least one other activating device (not shown) installed in the fuse housing. This second activating device is not part of the present invention and operates usually on a different principle than the device of the present invention.

Although the invention has been described in connection with a preferred embodiment thereof, it will be appreciated by those skilled in the art that additions, substitutions, modifications, and deletions may be made, without departing from the spirit and scope of the invention as defined in the appended claims.

I claim:

1. In a projectile fuse of the type comprising a housing, a bore in said housing, a vent arranged substantially concentrically in said bore, and closure means which is openable to expose the vent, the improvement wherein said closure means comprises:

a disk formed of a plurality of sectors and normally disposed in said bore in front of said vent, said disk being of smaller cross-section than said bore, and spring means mounted on said disk and acting upon said sectors to retain said sectors together, the size relationship between the cross-sections of said disk and said bore being such that with said sectors retained together by said spring means said vent is covered by a portion of said disk in any given position of said disk in said bore, said spring means being centrifugally responsive to allow said sectors to separate and expose said vent, said disk and spring means defining a unit which is freely movable within said bore transversely relative to the axis of said vent in the absence of centrifugal forces.

2. Apparatus according to claim 1, wherein said spring means comprises a coil spring surrounding said sectors.

3. Apparatus according to claim 2, wherein said coil spring comprises a winding of flat steel strip with 1.5 to 2 convolutions.

4. Apparatus according to claim 3, wherein said disk is arranged to perform a wobbling motion in said bore in response to impacting of the fuse, without exposing said vent.

* * * * *